United States Patent [19]

Gilbertson

[11] Patent Number: 4,565,303

[45] Date of Patent: Jan. 21, 1986

[54] DEVICE FOR DISPENSING PASTE FROM A TUBE

[76] Inventor: John E. Gilbertson, 2200 Ashworth Rd., West Des Moines, Iowa 50265

[21] Appl. No.: 667,207

[22] Filed: Nov. 1, 1984

[51] Int. Cl.[4] ..... B65D 35/28

[52] U.S. Cl. ..... 222/103; 222/105; 222/185

[58] Field of Search ..... 222/103, 105, 96, 181, 222/185, 214, 183, 212, 95

[56] References Cited

U.S. PATENT DOCUMENTS

| | | | |
|---|---|---|---|
| 2,537,008 | 1/1951 | Abbott | 222/103 X |
| 2,721,675 | 10/1955 | Buras, Jr. | 222/103 |
| 2,759,636 | 8/1956 | Albert et al. | 222/103 |
| 2,763,401 | 9/1956 | Buras, Jr. | 222/103 |
| 3,926,347 | 12/1975 | Low et al. | 222/214 X |
| 4,326,647 | 4/1982 | Pool | 222/103 |
| 4,413,757 | 11/1983 | Adler | 222/105 |

FOREIGN PATENT DOCUMENTS

| | | | |
|---|---|---|---|
| 1190344 | 10/1959 | France | 222/96 |

*Primary Examiner*—Joseph J. Rolla
*Assistant Examiner*—Kevin P. Shaver
*Attorney, Agent, or Firm*—Zarley, McKee, Thomte, Voorhees & Sease

[57] ABSTRACT

The device is provided for dispensing paste from a squeeze-type tube and comprises a base member for supporting the tube and a cover member disposed in movable covering relation over the tube and the base member, such that application of force to the cover member collapses the tube progressively from the rearward end to the forward end thereof so as to expel paste therefrom. The cover member is removable from the base member and includes an opening in the forward wall thereof through which the neck of the tube extends.

3 Claims, 7 Drawing Figures

DEVICE FOR DISPENSING PASTE FROM A TUBE

BACKGROUND OF THE INVENTION

Toothpaste and other semi-solid substances have long been packaged in collapsible tubes which can be manually squeezed to expel the paste therefrom. However, it is difficult to squeeze out all of the paste from such tubes. Also, such squeeze-type tubes are often difficult for children, elderly persons, and other people with hand problems to manipulate.

Therefore, a primary objective of the present invention is the provision of a device for dispensing paste from a tube which minimizes the waste remaining in the tube.

A further objective of the present invention is the provision of a device for dispensing paste from a tube which is easy for persons of all ages to handle.

Another objective of the present invention is the provision of a device for dispensing paste from a tube that is economical to manufacture, easy to use, and durable in use.

SUMMARY OF THE INVENTION

The device of the present invention for dispensing paste from a tube generally comprises a base member which supports the tube and a cover member which fits over the tube and the base member such that application of force to the cover member collapses the tube progressively from the rearward end to the forward end of the tube, thereby expelling paste therefrom. The base member includes a pair of outwardly extending nodules on either side thereof which frictionally engage the cover member to retain the cover member in covering relation with respect to the base member. Also, the cover member has an opening in the forward wall thereof through which the open end of the tube extends for closing by a cap.

DETAILED DESCRIPTION OF THE DRAWINGS

Figures 1, 2, 3, 4, 5, 6, 7:
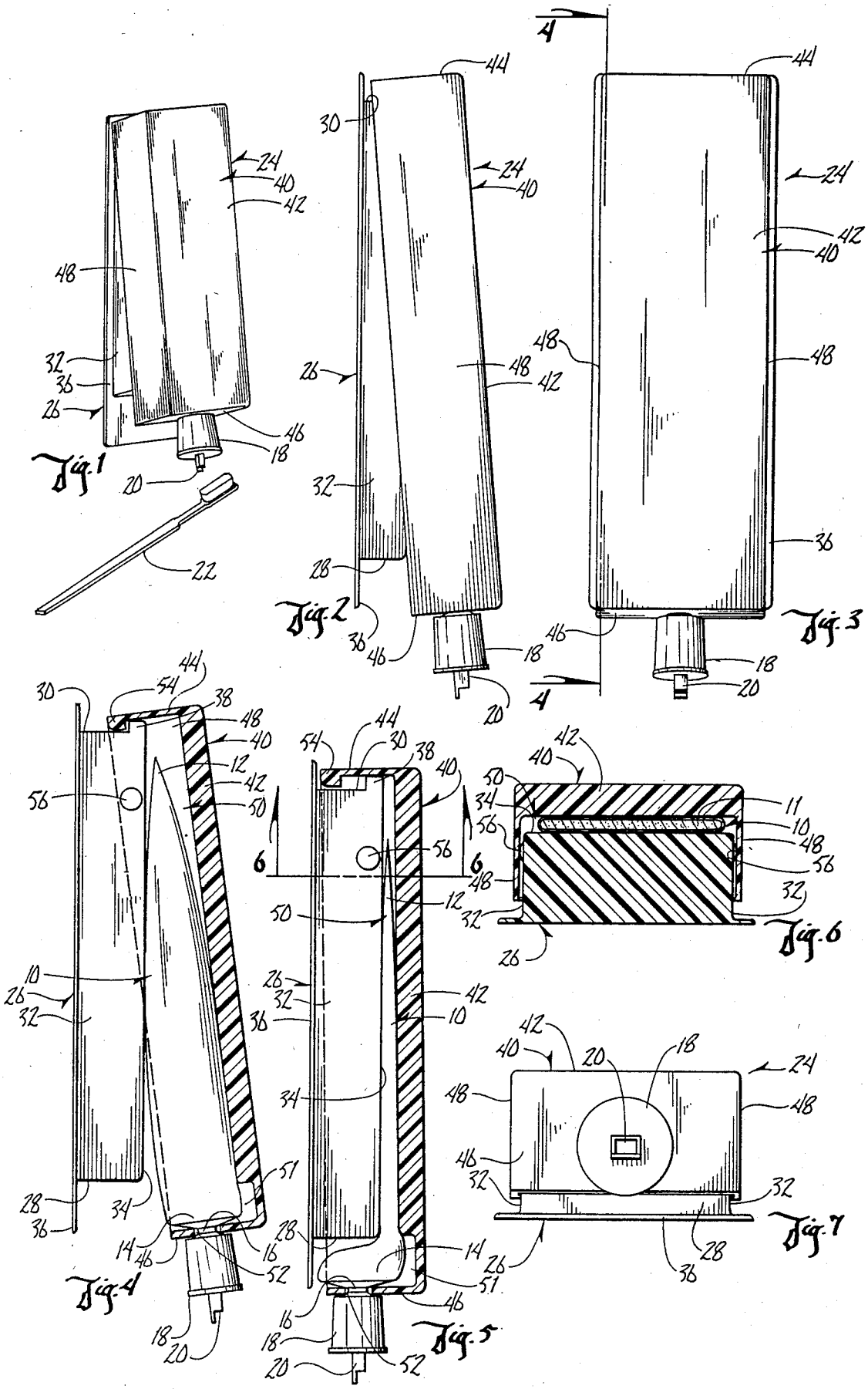
FIG. 1 is a perspective view of the device of the present invention.
FIG. 2 is a side elevational view of the device.
FIG. 3 is a top plan view of the device.
FIG. 4 is a sectional view taken along line 4—4 of FIG. 3 showing the device with a substantially full tube of paste positioned therein.
FIG. 5 is a view similar to FIG. 4 showing a substantially empty tube of paste within the device.
FIG. 6 is a sectional view taken along lines 6—6 of FIG. 5.
FIG. 7 is a front end view of the device.

A conventional squeeze-type tube is generally depicted in the drawings by the reference numeral 10. Tube 10 usually contains a semi-solid paste substance 11, such as toothpaste or the like. Tube 12 is elongated and has a rearward end 12 and a forward end 14. Forward end 14 includes a neck portion 16 with an opening therethrough for discharging the paste. A cap 18 can be threaded onto neck 16 or otherwise attached thereto for closing the opening therein. In the drawings. cap 18 is shown with a pivotable nozzle 20 for directing the paste onto a toothpaste 22, however, cap 18 may be any conventional cap for closing tube 10.

The device of the present invention is generally designated by the reference numeral 24 and generally includes a base member 26 having forward end 28, rearward end 30, opposite sides 32, and a support surface 34. Base member 26 may include a bottom plate 36 for mounting device 24 to the wall in any convenient manner. Base member 26 also includes a flange 38 extending outwardly from rearward end 30 thereof.

A cover member 40 fits in movable covering relation over base member 26. Cover member 40 includes a top wall 42, a rear wall 44, a front wall 46, and opposite side walls 48 which are integrally formed or otherwise interconnected to form a cavity 50 for housing tube 10. Cavity 50 may be enlarged, as at 51, adjacent the forward end of the cavity to provide room for the non-collapsible forward end 14 of tube 12. Front wall 46 includes an opening 52 through which neck 16 of tube 10 extends, as seen in FIGS. 4 and 5. Cover member 40 also includes a flange 54 extending inwardly from rear wall 44. Flange 54 of cover member 40 is adapted to overlap flange 38 of base member 26 to maintain the covering relationship of cover member 40 with respect to base member 26. It is understood that device 24 could have flanges extending along the sides of base member 26 and cover member 40, rather than flanges 38 and 54, as depicted, to maintain the covering relationship.

Base member 26 also includes a pair of nodules 56 which frictionally engage the interior surface of side walls 48 of cover member 40 to help retain cover member 40 in covering relation with respect to base member 26. Nodules 56 also provide a point about which cover member 40 tends to pivot with respect to base member 26.

To use device 24, cover member 40 is removed from base member 26 and tube 10 filled with paste 11 is positioned in cavity 50 of cover member 40. Cover member 40 is then locked into covering relationship with base member 26 by overlapping flange 54 thereof with respect to flange 38 of base member 26, as seen in FIG. 4. A force is then manually applied to cover member 40, which tends to pivot on nodules 56 of base member 26 so as to collapse tube 10 and thereby expel paste 11 therefrom. Device 24 tends to collapse tube 10 progressively from rearward end 12 towards forward end 14 as pressure is applied to cover member 40. As tube 10 is emptied of paste 11, cover member 40 moves downwardly over base member 26 as seen in FIG. 5.

Thus, device 24 collapses tube 10 progressively from rearward end 12 toward forward end 14 thereof and thereby minimizes the amount of wasted paste 11 remaining in tube 10. Also, since device 24 engages tube 10 along a substantial portion of the tube, rather than at any particular point along the tube, less force is required to discharge paste from the tube, thus permitting easier use by children, elderly people, and other people with arthritis or other hand problems.

Therefore, the present invention accomplishes at least all of its stated objectives.

What is claimed is:

1. A device for dispensing paste from a tube having a closed rearward end, an open forward end and a removable cap for closing said forward end, said device comprising:

a base member having a forward end, a rearward end, opposite sides, and a support surface for supporting said tube, a removable cover member adapted to fit in covering relation over said tube and said base member and having a top wall, a rearward wall, a forward wall having an opening therein, and opposite side walls, said top wall, rear wall, forward wall and side walls of said cover member forming a cavity for housing said tube with the forward end of said tube extending through said opening in said forward wall whereby application of force to said cover member collapses said tube such that paste is expelled therefrom, and a pair of nodules extending outwardly from said sides of said base member adjacent said rearward end thereof for slidably frictionally engaging said side walls of said cover member to provide a pivot point therebetween, said cover member being adapted to slide upon said nodules such that said pivot point moves closer to said top wall of said cover member as paste is expelled from said tube thereby minimizing the force required to expel paste from said tube and thereby collapsing said tube along the length thereof progressively from said rearward end to said forward end of said tube.

2. The device of claim 1 wherein said base member includes a flange and said cover member includes a flange, said flanges extending towards and overlapping one another to maintain said cover member in covering relation over said base member.

3. The device of claim 1 wherein said cavity is enlarged adjacent said forward wall of said cover member.

* * * * *